US006295833B1

(12) United States Patent
Hoffart et al.

(10) Patent No.: US 6,295,833 B1
(45) Date of Patent: Oct. 2, 2001

(54) CLOSED LOOP SINGLE MIXED REFRIGERANT PROCESS

(76) Inventors: Shawn D. Hoffart, 12301 W. 155th St., Overland Park, KS (US) 66221; Brian C. Price, 6236 W. 123rd St., Overland Park, KS (US) 66209

( * ) Notice: Subject to any disclaimer, the term of this patent is extended or adjusted under 35 U.S.C. 154(b) by 0 days.

(21) Appl. No.: 09/591,654

(22) Filed: Jun. 9, 2000

(51) Int. Cl.[7] ..... F25J 1/02
(52) U.S. Cl. ..... 62/613
(58) Field of Search ..... 62/611, 613

(56) References Cited

U.S. PATENT DOCUMENTS 5,196,260 * 3/1993 Dirschl et al. ..... 428/290
5,791,160 * 8/1998 Mandler et al. ..... 62/611
5,950,453 * 9/1999 Bowen et al. ..... 62/612

* cited by examiner

*Primary Examiner*—William Doerrler
*Assistant Examiner*—Malik N. Drake
(74) *Attorney, Agent, or Firm*—F. Lindsey Scott

(57) ABSTRACT

A closed loop single mixed refrigerant process and system wherein the process efficiency is increased by increasing the temperature of liquefied material produced in a heat exchange refrigeration zone and thereafter cooling the liquefied material by flashing a portion of the liquefied material to produce a cooler liquefied material and a flash gas a portion of which is recycled to the heat exchange refrigerator. The process and system provide increased process efficiency and flexibility.

20 Claims, 4 Drawing Sheets

CLOSED LOOP SINGLE MIXED REFRIGERANT PROCESS

BACKGROUND OF THE INVENTION

1. Field of the Invention

This invention relates to a closed loop single mixed refrigerant process wherein the capacity of the process can be increased by adjusting the temperature of the liquefied fluid material produced in the process.

2. Brief Description of the Prior Art

Because of its clean burning qualities and convenience, natural gas has been widely used in recent years. Many sources of natural gas are located in remote areas which are not conveniently available to any commercial markets for the gas. When pipelines are unavailable for transportation of the natural gas to a commercial market, the produced natural gas is often processed into a liquefied natural gas (LNG) for transport to market. One of the distinguishing features of an LNG plant is the large capital investment required for the plant. The liquefaction plant is made up of several basic systems including gas treatment to remove impurities, liquefaction, refrigeration, power facilities and storage and ship loading facilities. The cost of these plants can vary widely, but generally the cost of the refrigeration portion of the plant can account for up to 30% of the cost. LNG refrigeration systems are expensive because considerable refrigeration is necessary to liquefy the natural gas. A typical natural gas stream may be at a pressure from about 250 psig (pounds per square inch gauge) to about 1500 psig at temperatures from 40 to about 120° F. The natural gas, which is predominantly methane cannot be liquefied by simply increasing the pressure on the natural gas as is the case with heavier hydrocarbons used for energy purposes. The critical temperature of methane is −82.5° C. (−116.5° F.) which means that methane can only be liquefied below that temperature regardless of the pressure applied. Since natural gas is commonly a mixture of gases, it liquefies over a range of temperatures. The critical temperature of natural gas is typically between about −121° F. and about −80° F. Typically, natural gas compositions at atmospheric pressure will liquefy in the temperature range between about −265° F. and about −247° F. Since refrigeration equipment represents such a significant part of the LNG facility cost, a considerable effort has been made to reduce refrigeration costs.

Various refrigeration cycles have been used to liquefy natural gas, with the three most common being the cascade cycle which uses multiple single component refrigerants and heat exchangers arranged progressively to reduce the temperature of the gas to liquefaction temperature, the expander cycle which expands gas from a high pressure to a low pressure with a corresponding reduction in temperature and multi-component refrigeration cycles which use a multi-component refrigerant and specially designed heat exchangers to liquefy the natural gas.

Natural gas is also liquefied in many instances to enable the storage of natural gas at locations near a demand for the natural gas, for instance, in heavily populated residential areas where there may be a greater need for natural gas during winter months than can be met by the available pipeline system. In such instances, liquefied natural gas may be stored in tanks, underground storage cavities and the like so that it can be available for use during the peak load months. The plants used to liquefy such gas for such storage may be somewhat smaller than those used to liquefy natural gas at remote locations for shipment to markets and the like.

Other gases are also liquefied but with somewhat less frequency. Such gases may be liquefied by the processes discussed above.

Previously, substances such as natural gas have been liquefied by processes such as shown in U.S. Pat. No. 4,033,735, issued Jul. 5, 1977 to Leonard K. Swenson, and U.S. Pat. No. 5,657,643, issued Aug. 19, 1997 to Brian C. Price, both of which are hereby incorporated in their entirety by reference. In such processes, a single mixed refrigerant is used. These processes have many advantages over other processes such as cascade systems in that they require less expensive equipment and are less difficult to control than cascade type processes. Unfortunately, the single mixed refrigerant processes require somewhat more power than the cascade systems.

Cascade systems such as the system shown in U.S. Pat. No. 3,855,810, issued Dec. 24, 1974 to Simon et al, basically utilize a plurality of refrigerant zones in which refrigerants of decreasing boiling points are vaporized to produce a coolant. In such systems the highest boiling refrigerant, alone or with other refrigerants, is typically compressed, condensed and separated for cooling in a first refrigeration zone. The compressed, cooled, highest boiling point refrigerant is then flashed to provide a cold refrigeration stream which is used to cool the compressed highest boiling refrigerant in the first refrigeration zone. In the first refrigeration zone, some of the lower boiling refrigerants may also be cooled and subsequently condensed and passed to vaporization to function as a coolant in a second or subsequent refrigeration zone and the like. As a result, the compression is primarily of the highest boiling refrigerant and is somewhat more efficient than when the entire single mixed refrigerant stream must be compressed. As noted, however, such processes require more expensive equipment.

In view of the reduced equipment cost and reduced difficulty of control with a single mixed refrigerant process, a continuing search has been directed to the development of such a process where the power requirements are reduced and wherein greater process flexibility is available.

SUMMARY OF THE INVENTION

According to the present invention, a method is provided for improving the efficiency of a closed loop mixed refrigerant process for cooling a fluid material through a temperature range exceeding 200° F. to a temperature below about −200° F.

The method comprises adjusting the temperature of the liquid fluid material discharged from a refrigeration zone of the closed loop mixed refrigerant process to a temperature from about −200 to about −45° F., reducing the pressure on the liquid fluid material to reduce the temperature of the liquid fluid material to less than about −245° F. and produce a flash gas, separating at least a major portion of the flash gas from the liquid fluid material, heating at least a portion of the flash gas to a temperature above about 40° F., compressing at least a portion of the heated flash gas to a pressure at least equal to the pressure of the fluid material charged to the refrigeration zone; and combining at least a portion of the compressed heated flash gas with the fluid material charged to the refrigeration zone.

The method further comprises a method for increasing the efficiency and flexibility of a closed loop mixed refrigerant process for cooling a fluid material through a temperature range exceeding 200° F. to a temperature below about −200° F. by heat exchange with a single mixed refrigerant in a closed loop refrigeration cycle, the process comprising compressing a gaseous mixed refrigerant to produce a compressed mixed refrigerant, cooling the compressed mixed refrigerant, charging the cooled compressed mixed refrigerant to a refrigeration zone and cooling the compressed mixed refrigerant in the refrigeration zone to produce a substantially liquid mixed refrigerant; passing the liquid mixed refrigerant through an expansion valve to produce a low temperature coolant, passing the low temperature coolant in countercurrent heat exchange with the cooled compressed mixed refrigerant and the fluid material to produce the substantially liquid mixed refrigerant, a substantially liquid fluid material and the gaseous mixed refrigerant, the method comprising adjusting the temperature of the liquid fluid material to from about −200 to about 245° F., reducing the pressure on the liquid fluid material to reduce the temperature of the liquid fluid material to less than about −245° F. and produce a flash gas, separating at least a major portion of the flash gas from the liquid fluid material, heating at least a portion of the flash gas to a temperature above about 40° F., compressing at least a portion of the heated flash gas to a pressure greater than an inlet pressure of the fluid material into the refrigeration zone; and combining at least a portion of the compressed heated flash gas with the fluid material charged to the refrigeration zone.

The invention also comprises a closed loop single mixed refrigerant process for cooling a fluid material through a temperature range exceeding 200° F. to a temperature below about −200° F. by heat exchange with a single mixed refrigerant in a closed loop refrigeration cycle comprising compressing a gaseous mixed refrigerant to produce a compressed gaseous mixed refrigerant, cooling the compressed mixed refrigerant to produce a cooled compressed refrigerant, charging the cooled compressed refrigerant to a refrigeration zone and further cooling the cooled compressed refrigerant to produce a substantially liquid mixed refrigerant, passing the liquid mixed refrigerant through an expansion valve to produce a low temperature coolant, passing the low temperature coolant in countercurrent heat exchange with the cooled compressed refrigerant and the fluid material to produce the substantially liquid mixed refrigerant, a cooled substantially liquid fluid material at a temperature from about −200 to about −245° F. and gaseous mixed refrigerant, recycling the gaseous mixed refrigerant to compression, reducing the pressure on the substantially liquid fluid material to further reduce the temperature of the liquid fluid material to a temperature below about −245° F. and produce a flash gas, separating at least a major portion of the flash gas from the liquid fluid material to produce a separated flash gas, heating at least a portion of the separated flash gas to a temperature above about 40° F. to produce a heated separated flash gas, compressing at least a portion of the heated separated flash gas to a pressure greater than the pressure of the fluid material charged to the refrigeration zone to produce a compressed portion, and combining at least a portion of the compressed portion of the heated separated flash gas with the fluid material.

The invention further comprises a closed loop single mixed refrigerant system for cooling a fluid material through a temperature range exceeding 200° F. to a temperature below about −200° F. by heat exchange with a single mixed refrigerant in a closed loop refrigeration cycle comprising a mixed refrigerant suction drum, a compressor having an inlet in fluid communication with a gaseous mixed refrigerant outlet from the mixed refrigerant suction drum, a condenser having an inlet in fluid communication with an outlet from the compressor, a refrigerant separator having an inlet in fluid communication with an outlet from the first condenser, a refrigeration vessel including a first heat exchange passageway in fluid communication with a gaseous refrigerant outlet from the refrigerant separator and a liquid refrigerant outlet from the refrigerant separator, a second heat exchange passageway in fluid communication with a source of the fluid material, a third heat exchange passageway countercurrently positioned in the refrigeration vessel with respect to the first heat exchange passageway and the second heat exchange passageway, and an expansion valve in fluid communication with an outlet from the first heat exchange passageway and an inlet to the third heat exchange passageway, a recycled refrigerant line in fluid communication with an outlet from the third heat exchange passageway and an inlet to the mixed refrigerant suction drum, a liquefied fluid material line in fluid communication with an outlet from the second heat exchange passageway, an expander vessel in fluid communication with the liquefied fluid material line and having a liquefied fluid material outlet, a flash drum having an inlet in fluid communication with the reduced pressure liquefied fluid material outlet and a flash gas outlet and a liquid fluid material outlet, a heat exchanger having an inlet in fluid communication with the flash gas outlet and a heated flash gas outlet, and, a flash gas compressor in fluid communication with the heated flash gas outlet and having a recycle flash gas outlet in fluid communication with the second heat exchange passageway and a second flash gas outlet.

DESCRIPTION OF THE PREFERRED EMBODIMENTS

In the description of the Figures, the same numbers will be used to refer to corresponding elements throughout. Not all valves, pumps and the like necessary to achieve the desired flows have been shown since they are not necessary to the description of the present invention.

Figure 1:
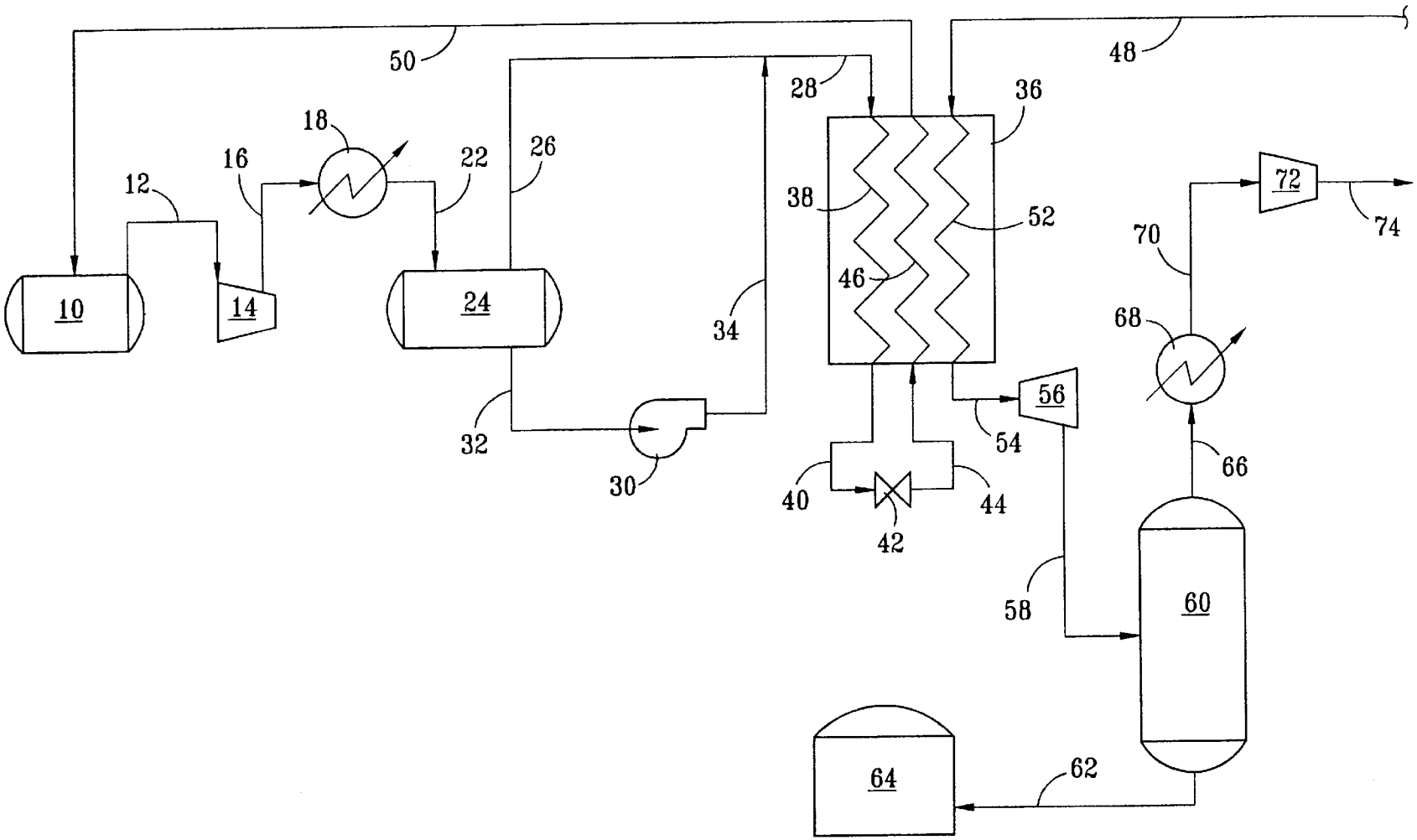
FIG. 1 PRIOR ART
FIG. 1 discloses a prior art closed loop mixed refrigerant process.

In FIG. 1 a prior art single mixed refrigerant closed loop system is shown. Mixed refrigerant is drawn from a refrigerant suction drum 10 and passed through a line 12 to a compressor 14. In compressor 14 the mixed refrigerant is compressed, discharged through a line 16 and passed to a heat exchanger 18 which functions as a refrigerant condenser where the mixed refrigerant is cooled by heat exchange with a coolant such as water, air or the like. The cooled compressed mixed refrigerant is then passed through a line 22 to a refrigerant separator 24 where it is separated into a liquid refrigerant portion and a gaseous refrigerant portion. The gaseous refrigerant is passed via a line 26 to a refrigerant and fluid material heat exchanger 36. The liquid refrigerant is withdrawn from separator 24 through a line 32 and passed to a pump 30 where it is pumped through a line 34 to a junction with line 26 and then through a line 28 to reconstitute the compressed mixed refrigerant. The mixed refrigerant is then passed through heat exchanger 36. The compressed mixed refrigerant is passed through heat exchanger 36 via a flow path 38 to a discharge line 40. The mixed refrigerant is desirably cooled in heat exchanger 36 to a temperature at which it is completely liquid as it passes from the heat exchanger into line 40. The refrigerant in line 40 is basically at the same pressure less line losses resulting from its passage through passageway 38 and line 40, as in line 28. The mixed refrigerant is passed through an expansion valve 42 where a sufficient amount of the liquid mixed refrigerant is flashed to reduce the temperature of the mixed refrigerant to the desired temperature. The desired temperature for natural gas liquefaction is typically a heat exchanger outlet temperature from about −230° F. to about −275° F. Typically, the temperature is about −235° F. The pressure is reduced across expansion valve 42 to a pressure from about 50 to about 75 psia. The low pressure mixed refrigerant boils as it proceeds via a flow path 46 through heat exchanger 36 so that the mixed refrigerant is gaseous as it is discharged into a line 50. Upon discharge into line 50, the mixed refrigerant is substantially vaporized. The gaseous mixed refrigerant passed through line 50 is passed through line 50 to refrigerant suction drum 10. In the event that any traces of liquid refrigerant are recovered through line 50, they are allowed to accumulate in refrigerant suction drum 10 where they eventually vaporize and remain a part of the mixed refrigerant passed through line 12 to compressor 14.

While other gases can be liquefied by the process described above, natural gas is the most commonly liquefied gas. The natural gas is typically dried and may be treated for the removal of materials such as sulfur compounds, carbon dioxide and the like. The natural gas is supplied to heat exchanger 36 through a line 48 and passes via a heat exchange path 52 through heat exchanger 36. The natural gas stream may be withdrawn from heat exchanger 36 at an intermediate point and passed to a heavy liquid separator section (not shown) where hydrocarbons containing 6 or more carbon atoms are preferentially separated and recovered, with the natural gas being returned from the separator to a continuation of heat exchange path 52 in heat exchanger 36. In some instances, it may be desirable to remove a $C_2$–$C_5$+ stream in the separator for use as a product or for other reasons. The use and operation of a suitable heavy liquid separator section is shown in U.S. Pat. No. 4,033,735, previously incorporated by reference. The separation of such heavy materials is considered to be well known to those skilled in the art. The separation of these heavier materials from the natural gas stream is necessary in some instances when the heavier materials are present in a natural gas which would otherwise freeze in passageway 52 as the natural gas is cooled to its liquid phase. Such compounds which could solidify in path 52 are removed so that no such heavy materials are present or a sufficiently small quantity of such heavy materials is present so that no precipitation of the solid materials occurs in passageway 52.

The liquefied natural gas is recovered from heat exchanger 36 through a line 54 at a temperature typically from about −230 to about −275° F. The liquefied natural gas is then passed through line 54 to an expansion valve, hydraulic turbine or other expansion device, or combination thereof, referred to herein as an expander 56, where the liquefied natural gas flashes to a lower pressure which lowers the liquefied natural gas temperature to about −260° F. at a pressure of about 1 atmosphere. At this temperature, the liquefied natural gas is suitably stored and maintained as a liquid at atmospheric pressure at a temperature from about −250 to about −60° F. As noted previously, such a process is described in U.S. Pat. No. 4,033,735, previously incorporated by reference.

The stream recovered from expander 56 via line 58 is passed to a separator 60 where a flash gas stream is recovered via a line 66 and liquefied natural gas is recovered via line 62 and passed to storage 64. The stream in line 66 is typically warmed in a heat exchanger 68 to a temperature from about 40 to about 130° F., preferably from about 70 to about 120° F., and passed to a compressor 72 where it is compressed to a suitable pressure for use as a fuel gas or the like.

In U.S. Pat. No. 5,657,643, also previously incorporated by reference, an improved process is shown wherein a plurality of compressors and intercoolers are used.

Figure 2:
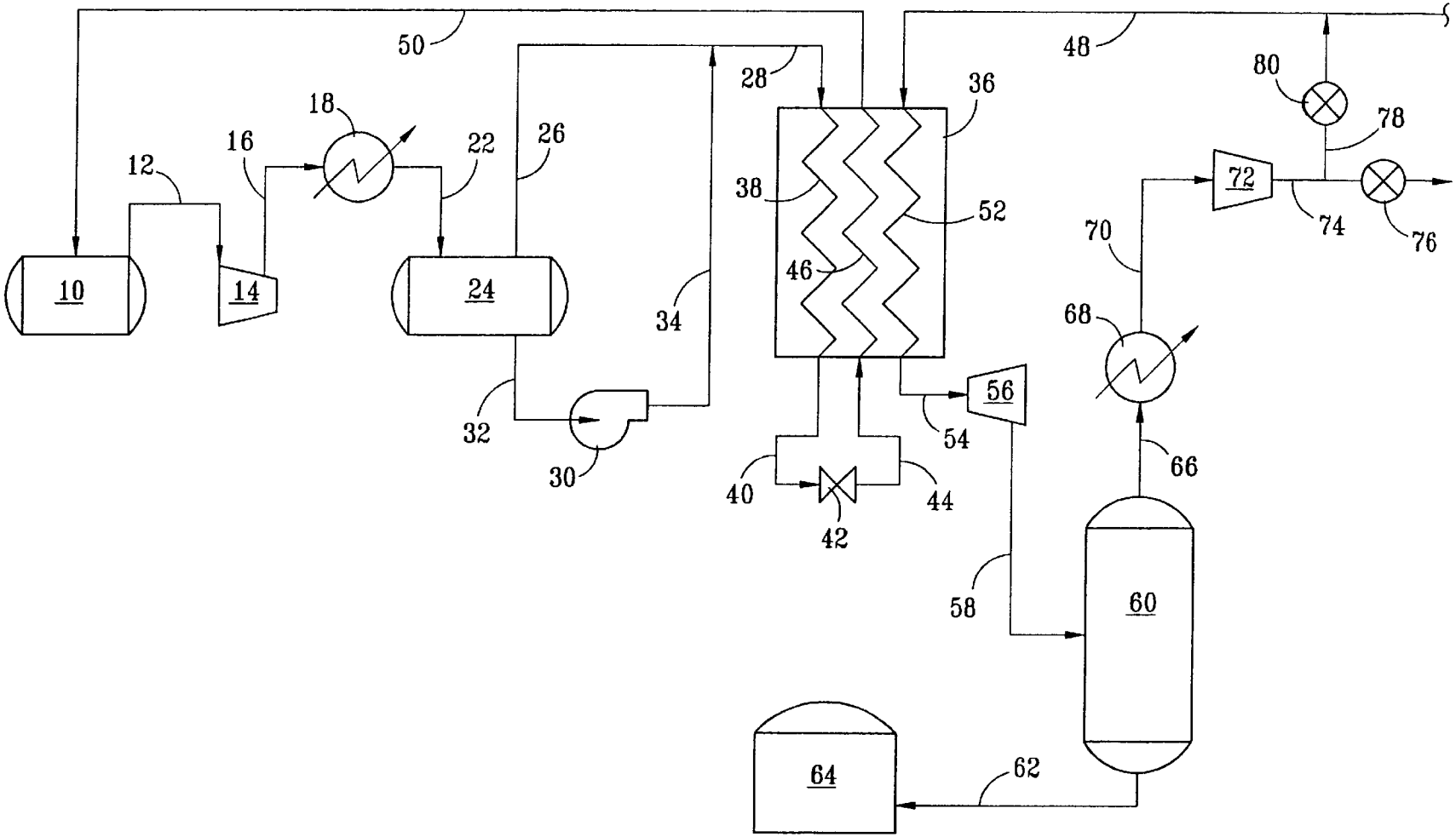
FIG. 2 shows a closed loop mixed refrigerant according to the present invention.

According to the present invention, as shown in FIG. 2, the flash gas stream passed to compressor 72 is compressed to a sufficient pressure to permit the return of a portion of the flash gas via a line 78 and a valve 80 to line 48 through which the inlet fluid material or natural gas flows to heat exchanger 36. A portion of the heated compressed gas is recovered through a line 74 and passed via a valve 76 to use as a fuel or other use.

In the use of closed loop mixed refrigerant processes, the amount of compression available is generally fixed when the process equipment is installed. As a result, the refrigeration capacity of heat exchanger 36 becomes fixed as a result of the limitations on the installed compression equipment. According to the present invention, when the temperature of the liquefied fluid material or natural gas recovered through line 54 is increased by from about 30 to about 75° F., additional flash gas is recovered in separator 60. Previously, it has been necessary to limit the temperature of the stream in line 54 to a temperature such that the amount of flash gas produced was equal to the demand for fuel gas in the LNG plant or by other consumers of natural gas in the area. Generally, liquefaction plants of this type are constructed in remote areas and there is little demand for natural gas other than to power the LNG plant itself. As a result, it was necessary to keep the temperature of the liquefied natural gas in line 54 relatively low (about −230 to about −275° F.) so that the amount of flash gas produced upon flashing was substantially equal to the demand for natural gas for operation of the plant. It was necessary to separate the flash gas, warm it to a usable temperature and compress it to a suitable pressure for use.

Typically, the pressure of the natural gas charged to such plants can vary widely depending upon the pressure of the gas in the formations from which it is produced, the pressure at which it is transported in the feed pipeline and the like. Typical pressures are from about 250 to about 1500 psig and more commonly from about 400 to about 1300 psig. When liquefied natural gas at this pressure is flashed to a very low pressure, such as from about 0 to about 50 psig and preferably from about 2 to about 15 psig, a substantial amount of flash gas is vaporized. As a result, the temperature of the liquefied natural gas is reduced by about 10 to about 70° F. after flashing. The amount of flash gas is determined by the temperature of the liquefied natural gas when the pressure is reduced. Desirably, the temperature of the liquefied gas in line 54 is selected to result in flashing only a sufficient amount of flash gas to serve as fuel gas for the facility and to provide the liquefied natural gas in line 62 for storage at a temperature below about −250° F., and preferably from about −250 to about −260° F. at a pressure of 1 atmosphere.

This severely restricts the operating parameters for the plant. The liquefied natural gas in line 54 must be cooled to a relatively low temperature unless there is a substantial demand for flash gas in the vicinity of the plant.

According to the present invention, the temperature of the liquefied natural gas stream in line 54 is increased by about 30 to about 75° F. (i.e. from a range from about −230 to about −275° F. to a range from about −200 to about −245° F.) so that considerably larger quantities of natural gas are flashed in LNG expander 56. Preferable temperature ranges in line 54 are from about −215 to about −235° F. This stream is then passed through line 58 to a separator 60 where increased quantities of natural gas (flash gas) are recovered through a line 66 and passed to heat exchanger 68. The temperature is desirably raised to a suitable temperature, i.e. typically from about 40 to about 130° F. and preferably from about 70 to about 120° F. with the gas then being passed to a compressor 72. In compressor 72 which is an independently powered compressor, which may be electrically powered or may be driven by a gas turbine or the like, the flash gas stream is compressed to a pressure sufficient for use as a fuel gas and for the return of a portion of the flash gas to the inlet natural gas stream passed to heat exchanger 36 via line 48.

By this process, additional capacity can be achieved by the addition of compression capacity in compressor 72 which is used to compress a recycle stream. Accordingly, a higher temperature can be used for the liquefied natural gas in line 54 which increases the efficiency of heat exchanger 36 since the heat exchange driving force in heat exchanger 36 is least at the lowest temperatures achieved in the natural gas stream in heat exchanger 36 and since the heat exchange capacity of heat exchanger 36 is limited by the available compression capacity of compressor 14. Since the heat duty on heat exchanger 36 is reduced by raising the temperature in line 54, a larger quantity of natural gas can be processed through the same equipment. As a result of the higher temperatures, more flash gas is recovered, but this gas can be readily recycled by recompressing it and recycling it as discussed previously. This permits an increased capacity in the installed equipment by the use of compressor 72 which can be used to compress varied amounts of flash gas depending upon the demands for fuel gas and the like. Furthermore, it has been found that by the use of the method of the present invention, greater process efficiency is also achieved.

EXAMPLE

Figure 3:
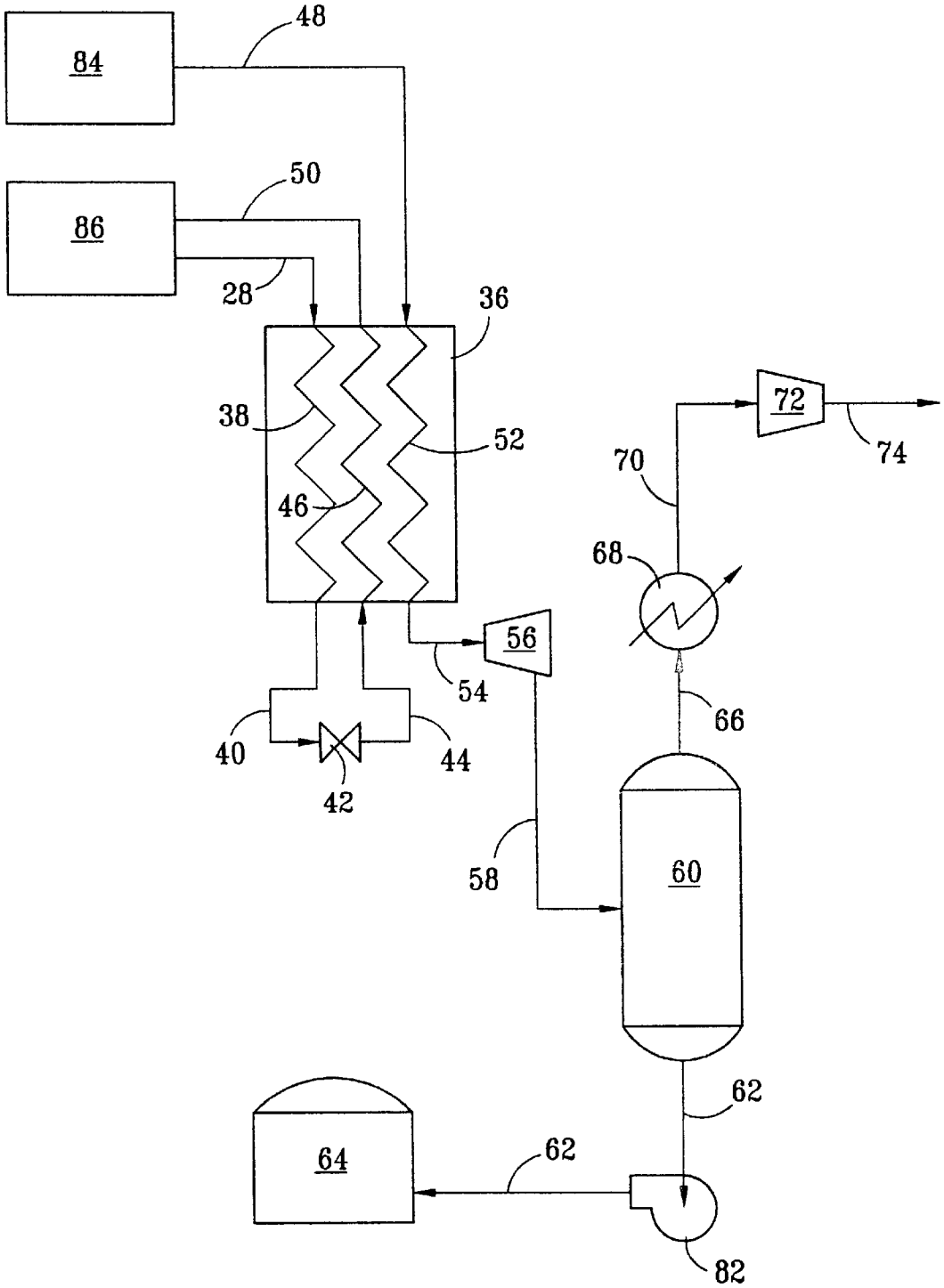
FIG. 3 PRIOR ART
FIG. 3 is a more detailed sketch of the products recovery section of the prior art process shown in FIG. 1; and, FIG. 4 is a more detailed section of the products recovery section shown in FIG. 3.
Figure 4:
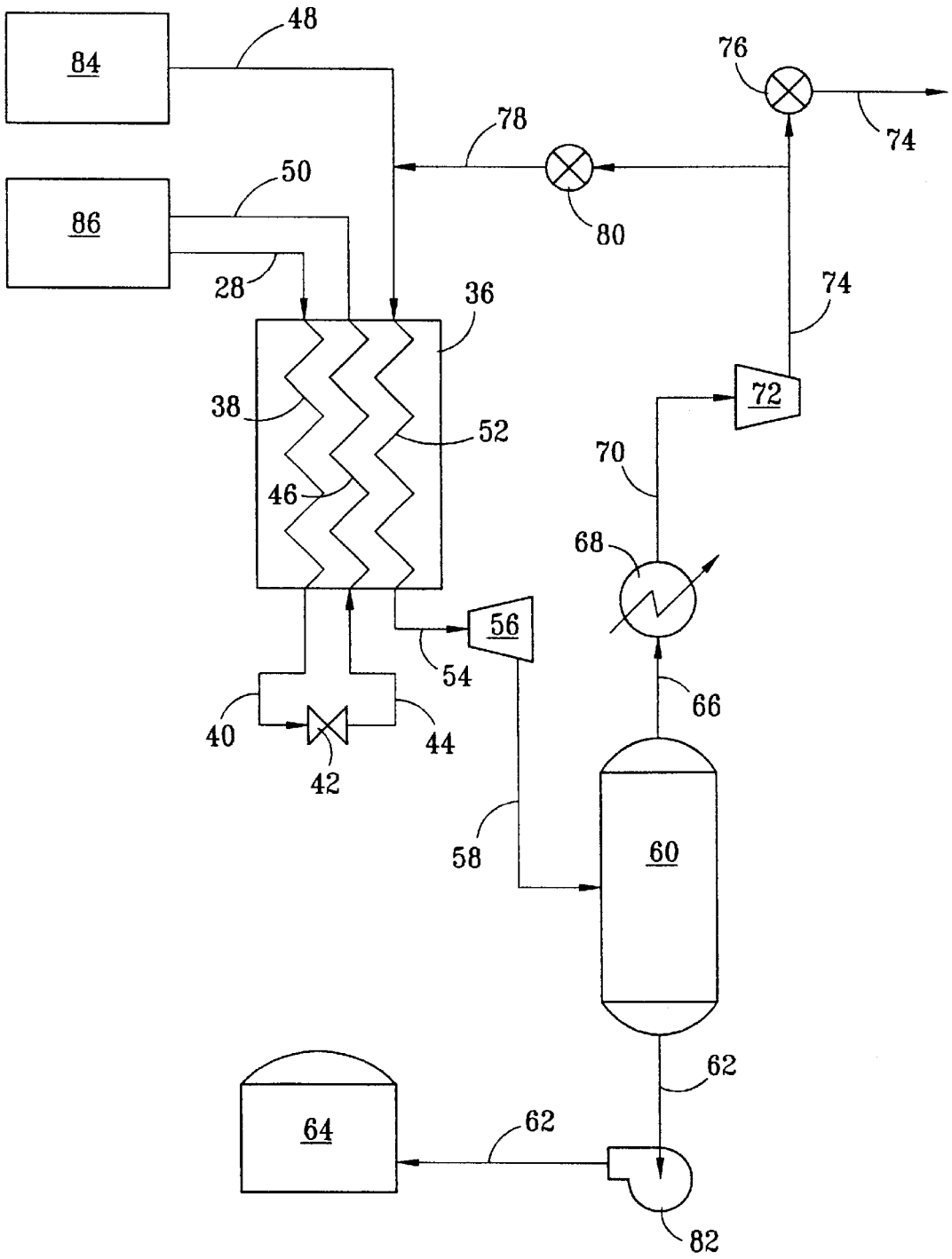

Comparative processes are shown in FIGS. 3 and 4. The process shown in FIG. 3 is a prior art process as shown in FIG. 1. FIG. 3 shows the process in somewhat greater detail for the natural gas recovery section. A pump 82 is shown in line 62 and a fuel gas treating section 84 is shown schematically with the refrigerant treatment section being shown schematically as 86.

FIG. 4 is a comparable, more detailed description of the process of the present invention.

A comparative embodiment of the process shown in FIG. 3 and the process shown in FIG. 4 are shown in some detail in Table 1.

TABLE 1

| FIG. 3 | | | FIG. 4 | | |
|---|---|---|---|---|---|
| Line No. | Temp (° F.) | Pressure (psig) | Line No. | Temp (° F.) | Pressure (psig) |
| 48 | 100 | 755 | 48 | 100 | 755 |
| 54 | −239.2 | 745 | 54 | −224.7 | 745 |
| 58 | −252.4 | 3 | 58 | −252.4 | 3 |
| 62 | −252.4 | 3 | 62 | −252.4 | 3 |
| 66 | −252.4 | 3 | 66 | −252.4 | 3 |

TABLE 1-continued

| FIG. 3 | | | FIG. 4 | | |
|---|---|---|---|---|---|
| Line No. | Temp (° F.) | Pressure (psig) | Line No. | Temp (° F.) | Pressure (psig) |
| 70 | 90 | 1 | 70 | 90 | 1 |
| 74 | 105 | 785 | 74 | 105 | 785 |
| | | | 78 | 105 | 785 |

It will be noted that the temperature in line 54 in the embodiment shown in FIG. 4 has been increased. Natural gas is still produced in line 62 at the same temperature and pressure. Similarly, fuel gas is still produced in line 74 at the same temperature and pressure. In the embodiment shown, the same quantity of liquefied natural gas is produced, but the power requirements for the operation of the overall process of FIG. 4 by comparison to FIG. 3 have been reduced by about 2.4 percent.

As described above, the method of the present invention is a method for increasing the efficiency and flexibility of operation for closed loop mixed refrigerant processes. The foregoing example clearly demonstrates increased efficiency of the process and it is inherent that with the increased temperature in line 54, increased quantities of liquefied natural gas can be produced in heat exchanger 36, if desired.

Having thus described the present invention by reference to its preferred embodiments, it is pointed out that the embodiments described are illustrative rather than limiting in nature, and that many variations and modifications are possible within the scope of the present invention. Many such variations and modifications may be considered obvious and desirable by those skilled in the art based upon a review of the foregoing description of preferred embodiments.

Having thus described the invention, we claim:

1. A method for improving the efficiency of a closed loop mixed refrigerant process for cooling a fluid material through a temperature range exceeding 200° F. to a temperature below about −200° F., the method comprising:

a) adjusting the temperature of the liquid fluid material discharged from a refrigeration zone of the closed loop mixed refrigerant process by from about 30 to about 75° F. to a temperature from about −200 to about −245° F.;

b) reducing the pressure on the liquid fluid material to reduce the temperature of the liquid fluid material to less than about −245° F. and produce a flash gas;

c) separating at least a major portion of the flash gas from the liquid fluid material;

d) heating at least a portion of the flash gas to a temperature above about 40° F.;

e) compressing at least a portion of the heated flash gas to a pressure at least equal to the pressure of the fluid material charged to the refrigeration zone; and, f) combining at least a portion of the compressed heated flash gas with the fluid material charged to the refrigeration zone.

2. The method of claim 1 wherein the fluid material is natural gas.

3. The method of claim 2 wherein the pressure on the liquid fluid material is reduced to a pressure below about 50 psia.

4. The method of claim 3 wherein the pressure is reduced to a pressure less than about 10 psia.

5. The method of claim 1 wherein the temperature of the liquid fluid material is reduced to at least about −250° F.

6. The method of claim 1 wherein the temperature of the liquid fluid material is reduced to at least about −260° F.

7. A method for increasing the efficiency and flexibility of a closed loop mixed refrigerant process for cooling a fluid material through a temperature range exceeding 200° F. to a temperature below about −200° F. by heat exchange with a single mixed refrigerant in a closed loop refrigeration cycle, the process comprising compressing a gaseous mixed refrigerant to produce a compressed gaseous mixed refrigerant, cooling the compressed mixed refrigerant, charging the cooled compressed mixed refrigerant to a refrigeration zone and cooling the compressed mixed refrigerant in the refrigeration zone to produce a substantially liquid mixed refrigerant; passing the liquid mixed refrigerant through an expansion valve to produce a low temperature coolant, passing the low temperature coolant in countercurrent heat exchange with the cooled compressed mixed refrigerant and the fluid material to produce the substantially liquid mixed refrigerant, a substantially liquid fluid material and the gaseous mixed refrigerant, the method comprising:

a) adjusting the temperature of the liquid fluid material by from about 30 to about 75° F. to a temperature from about −200 to about −245° F.;

b) reducing the pressure on the liquid fluid material to reduce the temperature of the liquid fluid material to a temperature less than about −245° F. and produce a flash gas;

c) separating at least a major portion of the flash gas from the liquid fluid material;

d) heating at least a portion of the flash gas to a temperature above about 40° F.;

e) compressing at least a portion of the heated flash gas to a pressure greater than an inlet pressure of the fluid material into the refrigeration zone; and, f) combining at least a portion of the compressed heated flash gas with the fluid material charged to the refrigeration zone.

8. The method of claim 7 wherein the fluid material is natural gas.

9. The method of claim 8 wherein the pressure on the liquid fluid material is reduced to a pressure below about 50 psia.

10. The method of claim 9 wherein the pressure is reduced to a pressure less than about 10 psia.

11. The method of claim 7 wherein the temperature of the liquid fluid material is reduced to at least about −250° F.

12. The method of claim 7 wherein the temperature of the liquid fluid material is reduced to at least about −260° F.

13. A closed loop single mixed refrigerant process for cooling a fluid material through a temperature range exceeding 200° F. to a temperature below about −200° F. by heat exchange with a single mixed refrigerant in a closed loop refrigeration cycle comprising:

a) compressing a gaseous mixed refrigerant to produce a compressed gaseous mixed refrigerant;

b) cooling the compressed mixed refrigerant to produce a cooled compressed refrigerant;

c) charging the cooled compressed refrigerant to a refrigeration zone and cooling the cooled compressed refrigerant to produce a substantially liquid mixed refrigerant;

d) passing the liquid mixed refrigerant through an expansion valve to produce a low temperature coolant;

e) passing the low temperature coolant in countercurrent heat exchange with the cooled compressed refrigerant and the fluid material at a pressure of at least about 50 psi to produce the substantially liquid mixed refrigerant, a cooled substantially liquid fluid material at a temperature from about −200 to about −245 ° F. and gaseous mixed refrigerant;

f) recycling the gaseous mixed refrigerant to compression;

g) reducing the pressure on the substantially liquid fluid material to further reduce the temperature of the liquid fluid material to a temperature below about −245 ° F. and produce a flash gas;

h) separating at least a major portion of the flash gas from the liquid fluid material to produce a separated flash gas;

i) heating at least a portion of the separated flash gas to a temperature from about 40 to about 130° F. to produce a heated separated flash gas;

j) compressing at least a portion of the heated separated flash gas to a pressure greater than the pressure of the fluid material charged to the refrigeration zone to produce a compressed portion; and, k) combining at least a portion of the compressed portion of the heated separated flash gas with the fluid material.

14. The method of claim 13 wherein the fluid material is natural gas.

15. The method of claim 14 wherein the pressure on the liquid fluid material is reduced to a pressure below about 50 psia.

16. The method of claim 15 wherein the pressure is reduced to a pressure less than about 10 psia.

17. The method of claim 13 wherein the temperature of the liquid fluid material is reduced to at least about −250° F.

18. A closed loop single mixed refrigerant system for cooling a fluid material through a temperature range exceeding 200° F. to a temperature below about −200° F. by heat exchange with a single mixed refrigerant in a closed loop refrigeration cycle comprising:

a) a mixed refrigerant suction drum;

b) a compressor having an inlet in fluid communication with a gaseous mixed refrigerant outlet from the mixed refrigerant suction drum;

c) a heat exchanger having an inlet in fluid communication with an outlet from the compressor;

d) a refrigerant separator having an inlet in fluid communication with an outlet from the heat;

e) a refrigeration vessel including a first heat exchange passageway in fluid communication with a gaseous refrigerant outlet from the refrigerant separator and a liquid refrigerant outlet from the refrigerant separator, a second heat exchange passageway in fluid communication with a source of the fluid material, a third heat exchange passageway countercurrently positioned in the refrigeration vessel with respect to the first heat exchange passageway and the second heat exchange passageway, and an expansion valve in fluid communication with an outlet from the first heat exchange passageway and an inlet to the third heat exchange passageway;

f) a recycled refrigerant line in fluid communication with an outlet from the third heat exchange passageway and an inlet to the mixed refrigerant suction drum;

g) a liquefied fluid material line in fluid communication with an outlet from the second heat exchange passageway;

h) an expander vessel in fluid communication with the liquefied fluid material line having a reduced pressure liquefied fluid material outlet;

i) a flash drum having an inlet in fluid communication with the reduced pressure liquefied fluid material outlet and a flash gas outlet and a liquid fluid material outlet;

j) a heat exchanger having an inlet in fluid communication with the flash gas outlet and a heated flash gas outlet; and, k) a flash gas compressor in fluid communication with the heated flash gas outlet and having a recycle flash gas outlet in fluid communication with the second heat exchange passageway and a second flash gas outlet.

19. The system of claim 18 wherein the compressor comprises a plurality of compressors.

20. The system of claim 18 wherein the fluid material is natural gas.

* * * * *